US005392837A

United States Patent [19]

Yukumoto et al.

[11] Patent Number: 5,392,837

[45] Date of Patent: Feb. 28, 1995

[54] APPARATUS FOR SEPARATING AND GUIDING A THIN STRIP PRODUCED BY CASTING

[75] Inventors: Masao Yukumoto; Michiharu Ozawa; Kiyoshi Shibuya; Saburo Moriwaki; Toru Sato, all of Chiba, Japan

[73] Assignee: Kawasaki Steel Corporation, Japan

[21] Appl. No.: 121,184

[22] Filed: Sep. 14, 1993

[30] Foreign Application Priority Data

Sep. 17, 1992 [JP] Japan ..... 247704

[51] Int. Cl.[6] ..... B22D 11/06

[52] U.S. Cl. ..... 164/417; 164/423

[58] Field of Search ..... 164/417, 477, 423, 429, 164/463, 479, 484; 242/78.8, 78.1

[56] References Cited

U.S. PATENT DOCUMENTS 4,977,949 12/1990 Shibuya et al. ..... 164/417

FOREIGN PATENT DOCUMENTS

| | | | |
|---|---|---|---|
| 57-94453 | 6/1982 | Japan | 164/463 |
| 57-154352 | 9/1982 | Japan | 164/463 |
| 59-125246 | 7/1984 | Japan | 164/429 |
| 63-76741 | 4/1988 | Japan | 164/463 |
| 64-62217 | 3/1989 | Japan | 242/78 |
| 1740126 | 6/1992 | U.S.S.R. | 164/417 |

*Primary Examiner*—J. Reed Batten, Jr.
*Attorney, Agent, or Firm*—Austin R. Miller

[57] ABSTRACT

Apparatus separates a thin metal strip produced from a molten metal from a surface of a cooling roll by rapidly solidifying using a single roll method and conveys and guides the separated thin strip downstream. A separation/tensioning/guiding unit is positioned adjacent the cooling roll to separate tension and guide the rapidly solidified thin strip, which unit includes a cooperating doctor blade in pressure contact with the cooling roll. A suction conveyor is provided downstream of the separation/tensioning/guiding unit.

17 Claims, 3 Drawing Sheets

APPARATUS FOR SEPARATING AND GUIDING A THIN STRIP PRODUCED BY CASTING

BACKGROUND OF THE INVENTION

1. Field of the Invention

The present invention relates to an apparatus for cooling a thin amorphous strip from molten metal by rapidly solidifying using a single roll method and for separating the strip from a cooling roll and smoothly running and guiding the separated thin strip for further processing, for example, to a coiling system.

2. Description of the Prior Art

The prior art discloses cooling a thin metal strip directly from molten metal by bringing the molten metal by a nozzle into contact with the peripheral surface of a cooling roll rotating at a high speed, casting and solidifying the metal. This is conducted in different ways broadly classified as the "single roll method" and the "twin roll method".

The single roll method is suitable for production of a thin metal strip having substantial width. In the single roll method the molten metal is ejected from a nozzle onto a roll rotating at a high speed. Consequently the molten metal forms a deposit which is spread to form a thin layer and is rapidly solidified to form an amorphous metal after the roll surface has moved a predetermined distance, i.e., after a predetermined angle of rotation of the roll. The amorphous metal is progressively separated from the roll surface by the centrifugal force generated as a result of rotation of the roll, so as to form a thin strip.

This single roll method, however, is generally run at a high producing speed of 20 m/sec or higher. In addition, the thickness of the thin metal strip formed by this method is 50 μm or below. Therefore, it has been difficult to separate the thin strip from the cooling roll reliably and to smoothly run and guide the separated strip to a subsequent apparatus, such as a pinch roll or a coiling system.

Japanese Patent Laid-Open Nos. Sho 57-39030 and Sho 57-94453 disclose separating a thin amorphous strip by solidifying from a cooling roll using an air jet. Employing an air jet has the disadvantage that the separation point of the thin strip produced by solidifying is unstable. When applied to a thin strip produced by solidifying and having substantial width, the thin strip separated from the cooling roll tends to run in a curved path, or to roll and break.

In employing an air jet, separation is unstable because the attaching force of the thin strip to the cooling roll changes with time, and differs in the width direction of the thin strip. This causes a serious problem in production of a thin strip having a width of as much as 150 mm or above by solidifying.

Japanese Patent Laid-Open No. Sho 54-50433 and Sho 59-27720 disclose a method of separating a rapidly solidified thin strip by a magnet roll or a magnet conveyor. This method is effective for a narrow thin strip having a low force of attachment to the cooling roll and which attaches to the cooling roll uniformly in the width direction. However, when this method is applied to a thin strip having a width of 150 mm or above, it is not possible to stabilize the path of the thin strip separated from the cooling roll. Consequently, the solidified thin strip tends to be tensioned excessively, and to break.

Japanese Utility Model Laid-Open No. Sho 61-63347 discloses a method of running and guiding a thin strip produced by casting to a coiling drum by pressing a scraper against the cooling roll. This running and guiding method is effective for a rapidly solidified thin strip having a width of 50 mm or below. However, when the width is 150 mm or above, it is not possible to stabilize the path of the thin strip separated from the cooling roll because the separated thin strip tends to stay at the distal end of the scraper. Further, the distal end of the thin strip may pass under the distal end of the scraper, thus making separation very unstable.

Among various proposed methods and arrangements for running and taking up a thin amorphous strip separated from a cooling roll, one practical method is to separate the thin amorphous strip from the cooling roll by causing it to fly suspended in the air along a curved path and to nip the flying strip between pinch rolls to guide the strip for further processing such as a coiling reel. Such a method or arrangement is employed, for example, as a means for taking up a rapidly solidified thin strip in coiling equipment, as disclosed in Japanese Patent Laid-Open Nos. Sho 61-167248 and Hei 1-143720.

The above-described method, however, suffers in that nipping of the flying thin strip in a curved path is difficult and time-consuming, and wastes a quantity of the thin amorphous strip that is produced until the flying strip has been successfully nipped.

SUMMARY OF THE INVENTION

An important object of the present invention is to provide an apparatus for reliably separating a thin amorphous strip produced by casting from a molten metal and for smoothly running and guiding the separated thin strip for further processing.

To this end, the present invention provides an apparatus which comprises a combination of an attracting means and a doctor blade provided in contact with the cooling roll, spaced apart and cooperating with each other to separate, tension and guide the rapidly solidified thin strip.

The present invention further provides an apparatus for separating a thin metal strip formed from a molten metal by solidifying using a single roll method from a surface of a cooling roll and for guiding the separated thin strip for further processing downstream of the cooling roll, which comprises a separation/tensioning/guiding means provided adjacent to the solidifying roll to separate/tension/guide the thin strip, including a cooperating doctor blade provided in contact at a spaced location with the solidifying roll, and a downstream suction conveyor to convey the thin strip.

In one preferred form of the present invention, the strip attracting means comprises a magnet roll including a cylinder which is rotatable at a high speed, adjacent the running strip and in the same direction, and a permanent magnet or an electromagnet located in a fixed position within the cylinder.

In another preferred form of the present invention, the attracting means comprises a suction roll including a cylinder which is rotatable at a high speed, adjacent the running strip and in the same direction, and a suction pad fixed within the rotating cylinder.

In still another preferred form of the present invention, the attracting means comprises a suction conveyor including a conveyor belt adjacent the strip and running in the same direction at a high speed, and a suction pad fixed in the conveyor belt to apply vacuum to the running strip.

The doctor blade utilized in accordance with this invention cooperates with the attracting means to separate, tension and guide the strip. The high speed of rotation of the cooling roll tends to produce unstable conditions with the strip undergoing random movements as it separates from the cooling roll, and the coaction between the attracting means and the doctor blade effectively controls these random movements. The doctor blade is preferably made of a material which does not damage the cooling roll, such as graphite carbon, a high-resistant resin or fiber, a stainless steel or a phosphor bronze. The distal end of the doctor blade is precision polished to about 1 S or below such that it forms an acute angle ranging from about 30° to 50° . The doctor blade is pressed against the surface of the cooling roll and is movable back and forth along the width direction of the thin strip.

The pressing force applied to the doctor blade against the cooling roll is between about 80 and 150 g/cm, and the widthwise movement speed of the doctor blade is between about 1 and 20 m/s.

DETAILED DESCRIPTION OF THE PREFERRED EMBODIMENTS

The present invention will now be described with reference to the accompanying drawings, which are intended to be illustrative but not to limit the scope of the invention, which is defined in the appended claims.

Figure 1:
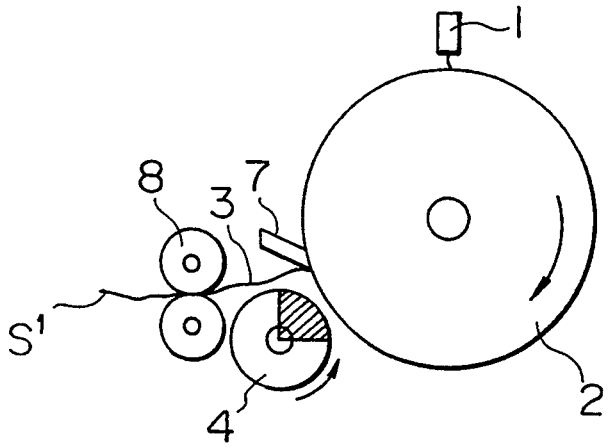
FIG. 1 schematically illustrates an apparatus in accordance with the present invention.

Referring to FIG. 1, a molten metal is poured from a nozzle 1 immediately above a cooling roll 2 rotating at a high speed. The molten metal makes contact with the cooling roll 2, and is thereby cast and solidified to form a thin metal strip 3. The thin metal strip 3 is formed in close contact with the surface of cooling roll 2 as a consequence of rotation of the cooling roll 2 through an angle of rotation until it reaches the desired point of separation from the cooling roll.

Reference numeral 4 in FIG. 1 denotes a magnet roll provided adjacent to the cooling roll 2. The magnet roll 4 includes an outer cylinder 6 (FIG. 2) which is rotatable at a high speed, and a permanent magnet or electromagnet 5 held at a fixed position inside the outer cylinder 6, with a small gap G between them.

The magnet roll 4 of FIG. 1 coacts with a doctor blade to be discussed in further detail hereinafter to separate the distal end $S^1$ of the thin strip 3 from the cooling roll 2 and to tension the distal end of the thin strip 3.

A desirable attracting force of the permanent magnet or electromagnet 5 is about 500 g, for example. The permanent magnet may be an Alnico magnet, for example. The peripheral speed of the magnet roll 4 is higher than the peripheral speed of the cooling roll 2 by about 5%, and it is rotated in a direction as shown by the arrow in FIGS. 1 and 2 so that its surface adjacent the strip is moving in the same direction as the strip.

Reference numeral 7 denotes a coacting doctor blade provided in contact with the cooling roll 2 and spaced along the periphery of roll 2 from the magnet roll 4 for stably separating the distal end of the thin strip 3 from the cooling roll 2. The doctor blade 7 is pressed against the cooling roll 2, and is movable back and forth in the width direction of the strip using conventional reciprocating means not shown. A desirable pressing force of the doctor blade against the cooling roll 2 is from about 80 to 150 g/cm, and a desirable moving speed thereof is from about 1 to 20 m/s.

A conventional motor or hydraulic device may be used for applying a pressing force to the doctor blade and as a means of moving the doctor blade back and forth.

The thin strip 3 separated from the cooling roll 2 by the magnet roll 4 and the doctor blade 7 is run and guided to pinch rolls 8 (FIG. 1) while it is tensioned by the magnet roll 4. A suitable tension applied to the distal end of the thin strip 3 by the magnet roll 4 is from about 5 to 50 g/mm$^2$.

The outer cylinder 6 may be made of a steel conforming to S45C, for example. A suitable gap G is provided between the outer cylinder 6 and the inner magnet 5. Its gap or distance is about 0.5 to 2 mm.

If the gap G is too small, a large driving force is necessary due to the high-speed rotation of the outer cylinder 6. Also, entry of dust makes maintenance difficult.

It is advantageous for the doctor blade 7 to be made of a material which does not damage the cooling roll, such as graphite carbon, a heat-resistant resin or fiber, or stainless steel or phosphor bronze, for example. The distal end of the doctor blade 7 is precision polished to about 1 S or below such that it forms an acute angle of about 30° to 50°.

Figure 3:
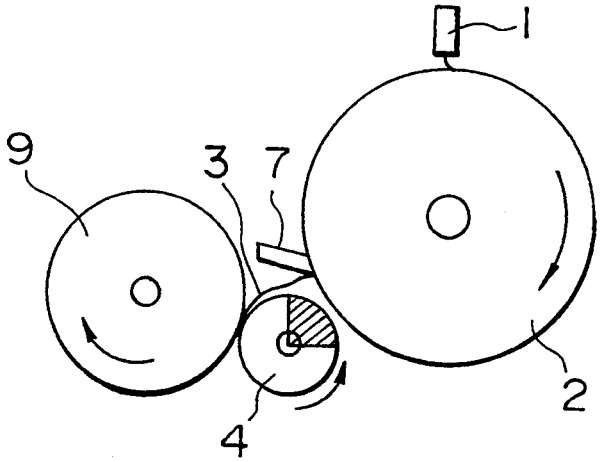
FIG. 3 schematically illustrates another example of an apparatus of the present invention.

FIG. 3 illustrates an embodiment of the invention in which the thin metal strip 3 is run and guided to a coiling device 9 by an apparatus otherwise similar to FIG. 1.

Figure 4:
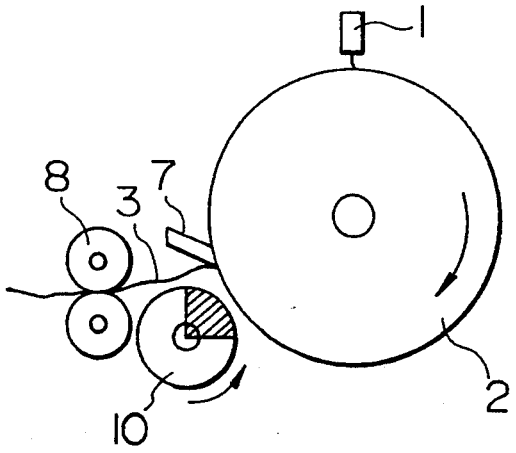
FIG. 4 schematically illustrates another embodiment of apparatus of the present invention.

In FIG. 4 the numeral 10 denotes a suction roll which cooperates with a doctor blade to separate and tension the distal end of the thin strip 3. A suitable suction force or attracting of the suction roll 10 on the strip is about 500 g, for example. The peripheral speed of the suction roll 10 is greater than the peripheral speed of the cooling roll 2 by about 5%, for example, and it runs so that the portion of its surface that is adjacent to the strip is moving in the same direction as the strip.

Figure 5:
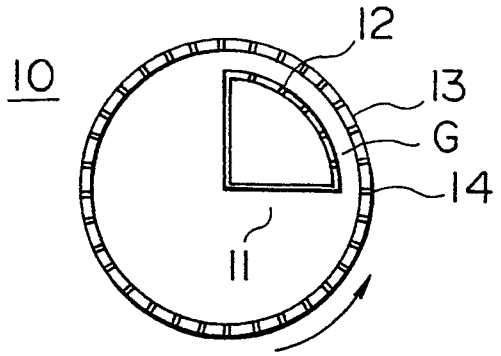
FIG. 5 is a schematic lateral cross-sectional view of a suction roll according to the present invention.

As shown in FIG. 5, the suction roll 10 includes a perforated outer cylinder 13 which is rotatable at a high speed, and a perforated suction pad 11 provided within the outer cylinder 13. A vacuum of about 100 to 500 mm of water is drawn by a vacuum blower connected at an end portion of the pad 11.

The outer cylinder 13 and the pad 11 are preferably made of steel conforming to, for example, S45C. Each of the perforations 12 and 14 has a diameter of about 1 to 3 mm, for example. A suitable gap G between the outer cylinder 13 and the pad 11 is between about 2 and 5 mm, for example.

When the gap G between the outer cylinder 13 and the pad 11 of FIG. 5 exceeds about 5 mm or when the perforations 12 of the pad 11 have diameters less than about 1 mm, an effective suction force cannot be obtained. In contrast, when the gap G between the outer cylinder 13 and the pad 11 is less than about 2 mm or when the perforations 12 of the pad 11 have diameters exceeding about 3 mm, an excessive suction force is exerted, making fine tension control of the thin strip 3 difficult.

In FIG. 4, reference numeral 7 denotes a cooperating doctor blade provided in contact with the cooling roll 2 for assisting the suction roll in stably separating the distal end of the thin strip 3 from the cooling roll 2. As in FIGS. 1 and 2, the doctor blade 7 presses against the cooling roll 2, and is movable back and forth along the width direction of the strip.

Figure 2:
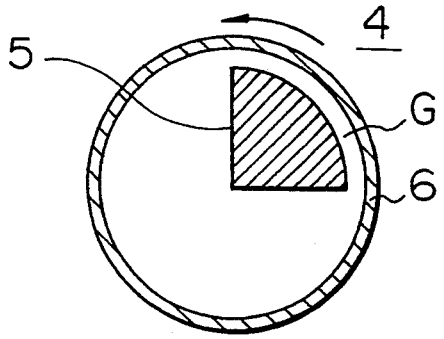
FIG. 2 is a schematic lateral cross-sectional view of a magnet roll according to the present invention.

A desirable pressing force of the doctor blade against the cooling roll 2 is from about 80 to 150 g/cm, and a desirable moving speed is from about 1 to 20 m/s, as in the cases of FIGS. 1 and 2.

The thin strip 3, separated from the cooling roll 2 by the combined effect of the suction roll 10 and the doctor blade 7, is run and guided to the pinch rolls 8 of FIG. 4 while it is tensioned by the suction roll 10. A suitable tension applied to the distal end of the thin strip 3 by the suction roll 10 is between about 5 and 50 g/mm$^2$.

Figure 6:
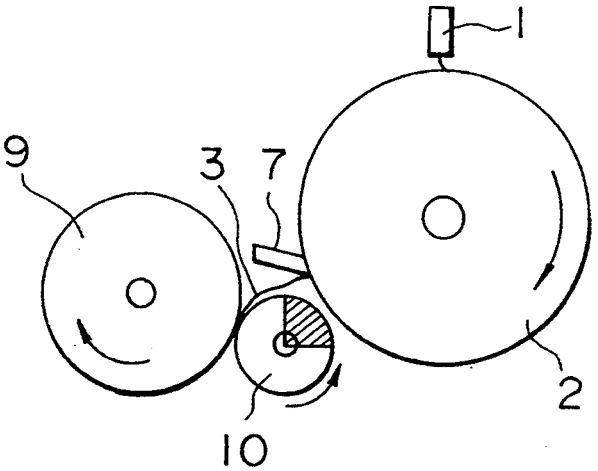
FIG. 6 is a schematic illustration of another example of apparatus of the present invention.

FIG. 6 illustrates an embodiment of the invention in which the thin strip 3 is run and guided to a coiling device 9; otherwise the apparatus is as shown in FIG. 4.

Figure 7:
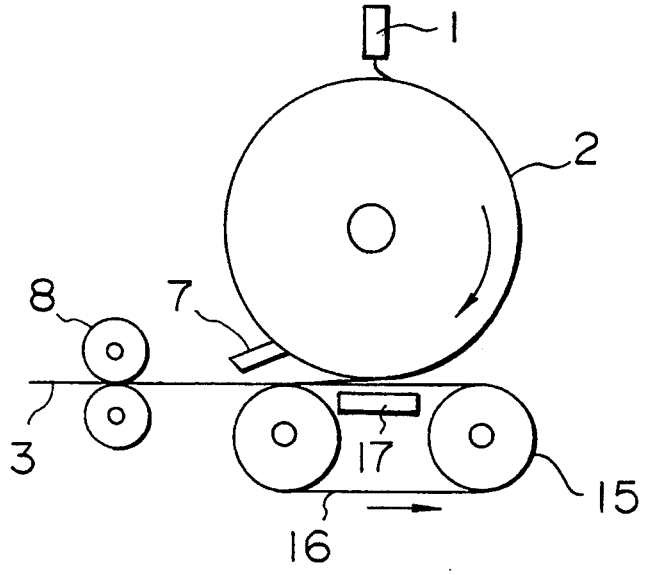
FIG. 7 is a schematic illustration of still another form of apparatus of the present invention.

FIG. 7 schematically illustrates an apparatus in which the thin metal rapidly solidified strip is guided to pinch rolls 8. Reference numeral 15 denotes a vacuum suction conveyor having a belt 16 provided adjacent to the cooling roll 2. The suction conveyor 15 separates the distal end of the thin strip 3 from the cooling roll 2 and applies tension to the thin strip 3. A suitable suction force of the suction conveyor 15 is about 500 g. The peripheral speed of the vacuum attracting conveyor 15 is higher than the peripheral speed of the cooling roll 2 by about 5%, and it runs in the same direction as the strip.

In the suction conveyor 15, a vacuum pad 17 is provided adjacent to the rear surface of the upper portion of conveyor belt 16. The vacuum pad 17 is preferably in the form of a box made of steel having perforations of about 1 to 3 mm on the surface thereof. Evacuation is performed by a vacuum blower of about 100 to 500 mm Aq from the outlet side of the vacuum pad 17.

The conveyor belt 16 is made of a low-friction material having a meshed configuration. In a practical operation, the conveyor belt 16 may be made of a resin or rubber. Each of the meshes preferably has a square shape and a size of about 1 to 5 mm. A suitable gap between the belt 16 and the pad 17 is between about 1 and 5 mm.

When the mesh of the belt 16 has a size of about 1 mm or below, when the gap between the belt 16 and the pad 17 exceeds about 5 mm or when the perforation of the pad 17 has a size of about 1 mm or below, a predetermined amount of suction force cannot be obtained. In contrast, when the mesh exceeds about 5 mm, when the gap between the belt 16 and the pad 17 is about 1 mm or below or when the perforation of the pad 17 has a size exceeding about 3 mm, an excessive amount of suction force is exerted, making fine tension control for the thin strip 3 difficult.

Reference numeral 7 of FIG. 7 denotes a cooperating doctor blade provided in contact with the cooling roll 2 for assisting the conveyor belt 16 in stably separating the distal end of the thin strip 3 from the cooling roll 2. As in the cases previously discussed herein, the doctor blade 7 presses against the cooling roll 2 and is movable back and forth in the width direction of the thin strip. A desirable pressing force is between about 80 and 150 g/cm, and a desirable moving speed is between about 1 and 20 m/s.

Figure 8:
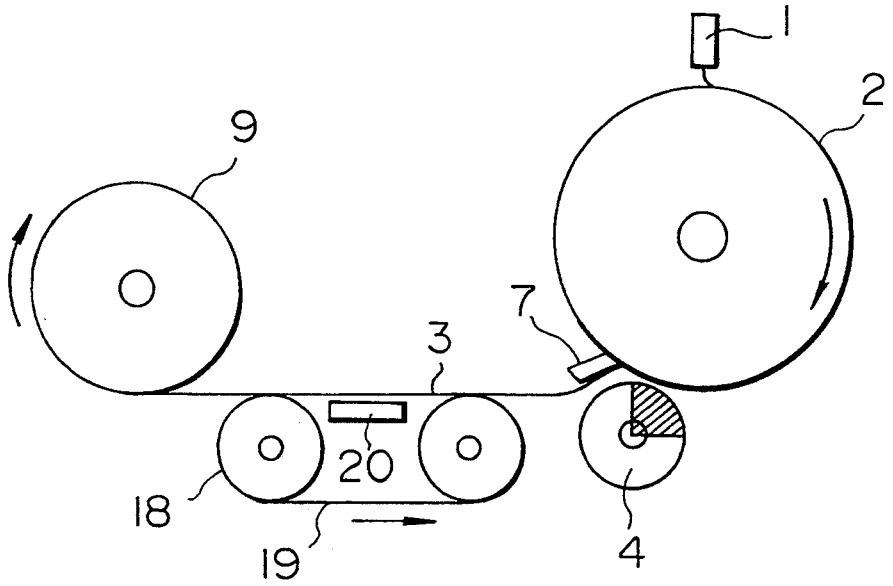
FIG. 8 is a schematic illustration of yet another apparatus of the present invention.

Referring now to FIG. 8, the numeral 18 denotes a vacuum suction conveyor provided between a magnet roll 4 and a coiling device 9. The thin strip 3 separated from the cooling roll 2 by the combined effects of the magnet roll 4 and the doctor blade 7 is guided to the coiling device 9 while tension is applied to the strip by the magnet roll 4. The thin strip is run to the coiling device 9 with reliability by the suction conveyor 18.

In the suction conveyor 18, a vacuum pad 20 is provided adjacent to the rear side of the upper portion of a conveyor belt 19.

The conveyor belt 19 has a mesh configuration.

In the structure shown in FIG. 8, a magnet roll 4 is employed as the separation, tensioning and guiding means. However, a suction roll or a suction conveyor may be employed in place of the magnet roll and combined with the use of a suction conveyor 18.

The operation of the apparatus in accordance with this invention will now be apparent. The molten metal, introduced at a pre-selected point around the periphery of the cooling roll, solidifies upon the cooling roll after rotation through a portion of a complete revolution, and solidifies in firm contact with the surface of the cooling roll. Especially in view of the high producing speeds attained in accordance with this invention, such as producing speeds of 20 m/sec or more, difficult and potentially unstable separation conditions are encountered when it is endeavored to separate, tension and guide the strip in a downstream direction. In accordance with the embodiment of FIG. 1, the magnet roll 4 is caused to rotate cocurrently with the cooling roll 2 and is spaced slightly from the cooling roll 2 at an angular location around a portion of an entire revolution. Positioned at a somewhat additional angle of rotation, downstream of the rotary movement of the cooling roll 2, is a doctor blade 7 as previously described in detail. It is an important feature of the invention that, under the conditions of instability that are frequently encountered under the high speed conditions existing, and particularly in view of the considerable width of the strip that can be produced in accordance with this invention, remarkable results are achieved by the combination of the magnet roll 4 and the doctor blade 7. If, at any instant, all or part of the strip 3 comes away from the cooling roll 2 as a part of the act of separation, it can easily contact the rapidly rotating outer surface of the cylinder 4, which is rotating cocurrently and urges the partially separating strip 3 in a downstream direction. Similarly, any portions of the separating strip that fly further in the direction of rotation of the cooling roll are caused to be controlled effectively by the doctor roll 7 which cooperates with the magnet roll 4 to guide the strip 3 in a direction between the pinch rolls 8, as shown in FIG. 1. Similar cooperation exists in the operation of the vacuum apparatus 10 of FIG. 4, in cooperation with the doctor roll 7. Similar cooperation appears in FIG. 7, involving the vacuum conveyor 16 and the doctor roll 7. In this manner, the cooperative effect of the various attracting means shown in all of the figures of the drawings with the spaced-apart doctor blade 7, provides remarkable control over the process of separating, tensioning and guiding the strip throughout a wide range of severe and difficult conditions.

The following examples illustrate runs conducted in accordance with this invention, and comparative runs as well.

EXAMPLES

Thin amorphous alloy strips whose composition essentially consisted of Fe 72 wt %, Si 8 wt % and B 10 wt % were produced by the single roll method using the various forms of apparatus shown in FIGS. 1, 4 and 7. The cooling roll had a diameter of 1 m, and the time it took for the thin strip to be separated from the cooling roll and to be nipped by the pinch rolls was measured. The results of the measurements are shown in Table 1 as Examples 1 through 4.

The peripheral speed of the cooling roll was 30 m/s. The thickness and the width of the formed thin strip were 20 μm and 200 mm, respectively. The tension applied to the distal end of each of the rapidly solidified thin strips was between 5 and 50 g/mm$^2$.

The doctor blade was made of graphite fiber. Its distal end was precision polished to 1 S or below such that it formed an acute angle of 30° to 50°. The angle of the doctor blade with respect to the cooling roll was between 10° and 30°. The pressing force of the doctor blade against the cooling roll was between 80 and 150 g/cm. The speed of movement of the doctor blade in the width direction of the thin strip was between 1 and 20 m/s.

In Examples 1 to 4 according to the present invention, the thin strip was successfully nipped by the pinch rolls in a very short time. The results of the tests appear in Table 1, including comparative examples of tests run with apparatus outside the scope of this invention.

TABLE 1

| No. | | Type of apparatus | Results of experiments | division |
|---|---|---|---|---|
| 1 | Doctor blade | Permanent magnet roll (FIG. 1) | Successfully nipped in 30 seconds | Example of the present invention |
| 2 | Doctor blade | Electromagnet roll (FIG. 1) | Successfully nipped in 30 seconds | Example of the present invention |
| 3 | Doctor blade | Suction roll (FIG. 4) | Successfully nipped in 40 seconds | Example of the present invention |
| 4 | Doctor blade | Suction conveyor (FIG. 7) | Successfully nipped in 60 seconds | Example of the present invention |
| 5 | Air knife | Electromagnet roll | Nipping failed in 30 seconds | Comparative example |
| 6 | Air knife | Suction roll | Nipping failed in 10 seconds | Comparative example |
| 7 | Air knife | Suction conveyor | Stable nipping unsuccessful for 60 seconds | Comparative example |
| 8 | — | Electromagnet roll only | Nipping failed in 5 seconds | Comparative example |
| 9 | — | Suction roll only | Nipping failed in 5 seconds | Comparative example |
| 10 | — | Suction conveyor only | Nipping failed in 5 seconds | Comparative example |
| 11 | Air knife | A fixed hood was provided between cooling roll and pinch rolls and the thin strip was sucked by a blower | Nipping unsuccessful for 90 seconds or longer | Comparative example |

Comparative Examples Nos. 5 through 7 in Table 1 show cases in which an air knife was used in place of the doctor blade in the apparatus shown in FIGS. 1, 4 and 7. In either case, the thin strip could not successfully be nipped by the pinch rolls.

Comparative Examples Nos. 8 through 10 in Table 1 show cases in which neither doctor blade nor air knife was used in the apparatus shown in FIGS. 1, 4 and 7. In either case, nipping of the thin trip by the pinch rolls failed in a short time.

Comparative Example No. 11 shows the case in which a hood was provided between the cooling roll and the pinch rolls; the thin strip located within the hood was intended to be attracted by a blower. In that case, it took more than 90 seconds for the thin trip to be nipped by the pinch rolls.

As will be understood from the foregoing description, in the present invention, since the thin strip formed from a molten metal by casting using the single roll method can be reliably separated from the cooling roll and the separated thin strip can be run and guided quickly to pinch rolls or a coiling device, yield, productivity and product quality are significantly improved.

What is claimed is:

1. An apparatus for separating from a surface of a cooling roll a thin metal strip formed from a molten metal by casting, and for guiding the separated thin strip thereafter, said apparatus comprising:

an attracting means adjacent to said cooling roll to exert a force on said strip influencing said strip to be separated, tensioned and guided; and a doctor blade downstream from said attracting means and in contact with said cooling roll and cooperating with said attracting means to effect the separation, tensioning and guiding of said metal strip.

2. The apparatus for separating and guiding a rapidly solidified thin strip according to claim 1, wherein said attracting means comprises a magnet roll including an outer cylinder which is rotatable at a high speed adjacent said cooling roll, and a magnet fixed in said outer cylinder.

3. The apparatus for separating and guiding a rapidly solidified thin strip according to claim 1, wherein said attracting means comprises a suction roll which includes an outer cylinder which is rotatable at a high speed adjacent said cooling roll, and a suction pad fixed in said outer cylinder.

4. The apparatus for separating and guiding a rapidly solidified thin strip according to claim 1, wherein said attracting means comprises a suction conveyor which includes a conveyor belt capable of movement at a high speed adjacent said cooling roll, and a suction pad fixed in said outer conveyor belt.

5. (Amended) The apparatus for separating and guiding a rapidly solidified thin strip according to any of claims 1, 2, 3 or 4, wherein said doctor blade is made of a material which does not damage said cooling roll, and is selected from the group consisting of graphite carbon, a high-resistant resin or fiber, stainless steel and phosphor bronze, and wherein a distal end of said doctor blade is precision polished to about 1 S or below such that it forms an acute angle ranging from about 30° to 50°.

6. The apparatus for separating and guiding a rapidly solidified thin strip according to claim 1, wherein means are provided for pressing said doctor blade against said cooling roll and for moving said doctor blade back and forth along the width direction of said thin strip.

7. The apparatus for separating and guiding a rapidly solidified thin strip according to claim 6, wherein the pressing force applied to said doctor blade is between about 80 and 150 g/cm, and the moving speed of said doctor blade is between about 1 and 20 m/s.

8. The apparatus defined in claim 2 wherein said outer cylinder rotates at a speed about 5% greater than said cooling roll.

9. The apparatus defined in claim 3 wherein said outer cylinder rotates at a speed about 5% greater than said cooling roll.

10. The apparatus defined in claim 4 wherein said conveyor belt moves at a speed about 5% greater than said cooling roll.

11. An apparatus for separating from a surface of a cooling roll a thin metal strip solidified from molten metal by casting, and for guiding the separated thin strip to a downstream processing apparatus comprising:

an attracting means adjacent to said cooling roll to influence separation of the rapidly solidified thin strip from said cooling roll;

a doctor blade provided in contact with said cooling roll and cooperating with said attracting means to effect said separation, tensioning and guiding; and a suction conveyor located downstream of said attracting means and doctor blade to further convey the thin strip.

12. The apparatus for separating and guiding a rapidly solidified thin strip according to claim 11, wherein said doctor blade is made of a material which does not damage said cooling roll, and is selected from the group consisting of graphite carbon, a high-resistant resin or fiber, stainless steel and phosphor bronze, and wherein a distal end of said doctor blade is precision polished to about 1 S or below such that it forms an acute angle ranging from about 30° to 50°.

13. In an apparatus for making metal strip wherein molten metal is solidified by applying it at a selected location to the rotating surface of a cooling roll which is rotated in a given direction, the combination which comprises:

(a) attracting means positioned adjacent the rotating surface of said cooling roll at an angular location around the circle of rotation of said cooling roll where metal solidification has taken place, said attracting means being operative and effective to loosen solidified metal strip relative to the surface of said cooling roll at said angular location, which is spaced around the angle of rotation of the cooling roll from said location at which the molten metal is applied, and (b) a doctor blade positioned against the surface of said cooling roll at an angular location farther around said angle of rotation than is said attracting means, said doctor blade being in a position to cooperate with said attracting means to separate said strip from said cooling roll under the combined influence of said attracting means.

14. The apparatus for separating and guiding a rapidly solidified thin strip according to claim 13, wherein said attracting means comprises a magnet roll including an outer cylinder which is rotatable at a high speed adjacent said cooling roll, and a magnet fixed in said outer cylinder.

15. The apparatus defined in claim 14 wherein said outer cylinder rotates at a speed about 5% greater than said cooling roll.

16. The apparatus for separating and guiding a rapidly solidified thin strip according to claim 13, wherein said attracting means comprises a suction roll which includes an outer cylinder which is rotatable at a high speed adjacent said cooling roll, and a suction pad fixed in said outer cylinder.

17. The apparatus defined in claim 16 wherein said outer cylinder rotates at a speed about 5% greater than said cooling roll.

* * * * *